US007712344B2

(12) United States Patent
Shen

(10) Patent No.: US 7,712,344 B2
(45) Date of Patent: May 11, 2010

(54) KEY-CHANGEABLE LOCK

(75) Inventor: Yang Shen, Suzhou (CN)

(73) Assignee: AOBA Security Technology Pte, Ltd., Singapore (SG)

( * ) Notice: Subject to any disclaimer, the term of this patent is extended or adjusted under 35 U.S.C. 154(b) by 0 days.

(21) Appl. No.: 10/582,198

(22) PCT Filed: Dec. 17, 2004

(86) PCT No.: PCT/CN2004/001461

§ 371 (c)(1),
(2), (4) Date: Jun. 9, 2006

(87) PCT Pub. No.: WO2005/061830

PCT Pub. Date: Jul. 7, 2005

(65) Prior Publication Data

US 2007/0101782 A1 May 10, 2007

(30) Foreign Application Priority Data

Dec. 22, 2003 (CN) ..... 2003 2 0123249 U

(51) Int. Cl.
*E05B 27/04* (2006.01)

(52) U.S. Cl. ..... 70/495; 70/340; 70/384; 70/492

(58) Field of Classification Search ..... 70/337–343, 70/382–385, 389, 492–496, 368
See application file for complete search history.

(56) References Cited

U.S. PATENT DOCUMENTS 4,966,021 A * 10/1990 Boag ..... 70/383
5,211,044 A 5/1993 Kim ..... 70/371
6,119,495 A * 9/2000 Loreti ..... 70/340
6,860,131 B2 * 3/2005 Armstrong et al. ..... 70/492
7,007,528 B2 * 3/2006 Chong et al. ..... 70/492
2005/0016234 A1 * 1/2005 Strader et al. ..... 70/492

FOREIGN PATENT DOCUMENTS

| | | |
|---|---|---|
| CN | 2093219 | 1/1992 |
| CN | 2395003 | 9/2000 |
| JP | 7207995 | 8/1995 |
| JP | 2000160888 | 6/2000 |

OTHER PUBLICATIONS

International Search Report dated Apr. 7, 2005 from PCT/CN/2004/001461.

* cited by examiner

*Primary Examiner*—Peter M Cuomo
*Assistant Examiner*—Kristina R Fulton
(74) *Attorney, Agent, or Firm*—Ohlandt, Greeley, Ruggiero & Perle, LLP

(57) ABSTRACT

The invention relates to a key-changeable lock including a lock housing and a lock cylinder provided within the lock housing. The lock cylinder includes a shell for the lock cylinder, a locking hole into which a key can be inserted and a locking block mounted on the shell. A sliding block and a toothed piece are provided in the shell. The locking block is abutted against the sliding block. Several toothed slides are slidably provided within the sliding block. The locking block can be located at two working positions. At a first working position, the locking block is not held in the block groove and the teeth of the toothed piece engage with those of the toothed slide. At a second working position, the locking block is held in the block groove and the teeth of the toothed piece disengage from those of the toothed slide.

20 Claims, 3 Drawing Sheets

KEY-CHANGEABLE LOCK

FIELD OF THE INVENTION

The invention relates to a key-changeable lock.

BACKGROUND ART

A conventional lock includes a lock housing and a lock cylinder provided within the lock housing. The lock cylinder includes a shell for the lock cylinder, a locking hole provided in the shell into which a key can be inserted, and a locking block slidably mounted on the shell. Typically, one key can just unlock one lock. Therefore, people have to hold a group of various keys corresponding to different locks, and it is inconvenient to find out the key corresponding with a particular lock from the group of keys. If the group of keys were lost or were duplicated by other people for purpose of hostility, all the locks corresponding with the group of keys must be replaced and thus it is very inconvenient to do so. Therefore, for the conventional locks, they are impossible to be used with a new key after the original key is lost.

SUMMARY OF THE INVENTION

It is an object of the invention to provide a key-changeable lock, wherein the key of the lock can be substituted.

In order to achieve above object, the invention provides a key-changeable lock as defined bellow. The key-changeable lock includes a lock housing and a lock cylinder provided within the lock housing. The lock cylinder includes a shell, a locking hole provided on the shell and into which a key can be inserted, and a locking block slidably mounted on the shell. A sliding block is slidably provided in the shell. Several toothed slides are slidably provided within the sliding block. A toothed piece is slidably disposed within the shell. The toothed piece is provided with a block groove. The locking block can be located at two working positions. At a first working position, the locking block is not held in the block groove and the teeth of the toothed piece engage with those of the toothed slide. At a second working position, the locking block is held in the block groove and the teeth of the toothed piece disengage from those of the toothed slide.

According to above technical solution, the advantage of the invention compared with the prior art is the key-changeable lock. Because the engagement between the teeth in the lock cylinder can be changed by the key, it is possible to change the key of the lock so that a new key can be substituted for the old key and the old key can be invalided. Therefore, after the key is lost or duplicated by others, it is just necessary to substitute a new key without substituting the lock cylinder.

LIST OF REFERENCE NUMBERS

1. locking block; 2. lock cylinder; 3. toothed piece; 4. toothed slide; 5. compression spring; 6. sliding block; 7. spring; 8. key; 9. lock housing; 10. pin; 11. locking hole; 12. shell for the lock cylinder; 13. bore for compression spring; 14. spring bore; 15. block groove; 16. contactor; locking groove; and 18. guiding slant.

DETAILED DESCRIPTION OF THE PREFERRED EMBODIMENT

Figure 1:
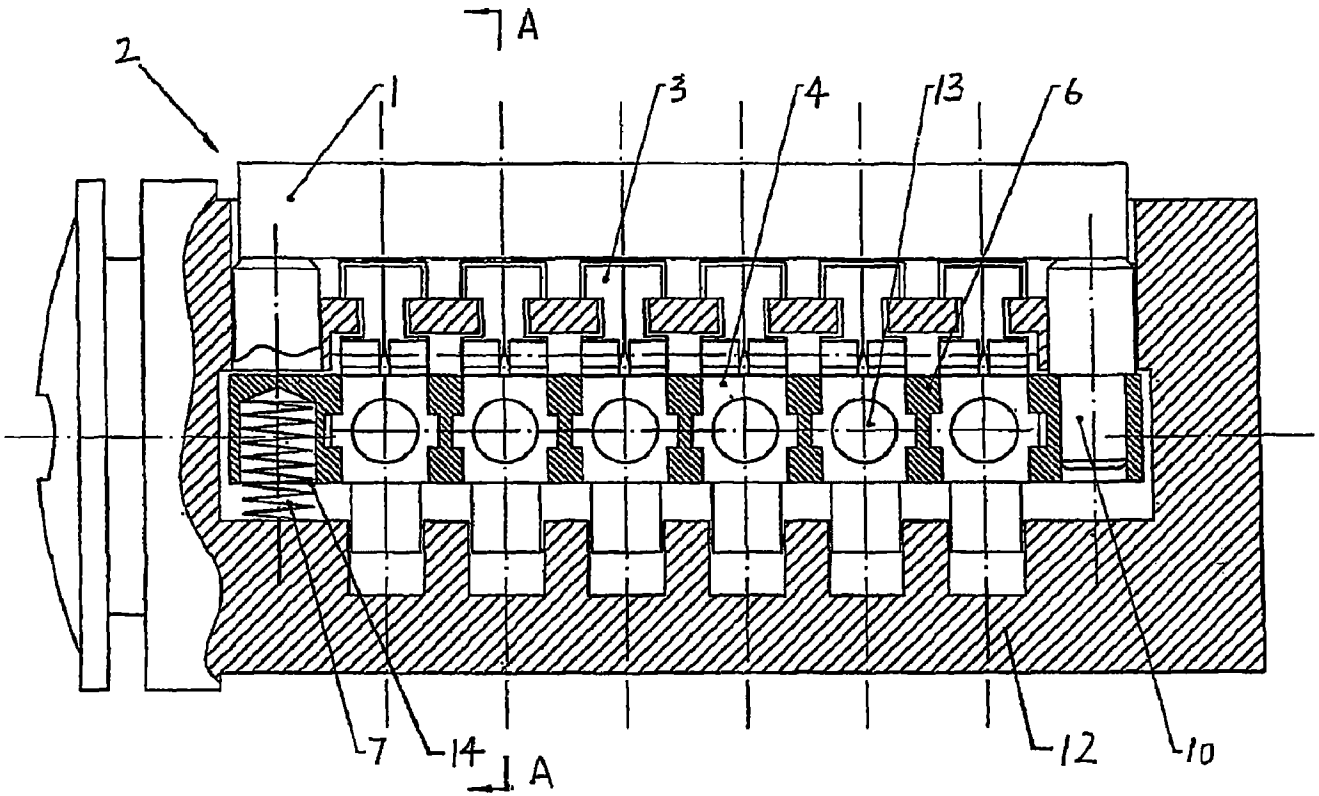
FIG. 1 is a front cross-sectional view of an embodiment of a lock according to the invention.
Figure 2:
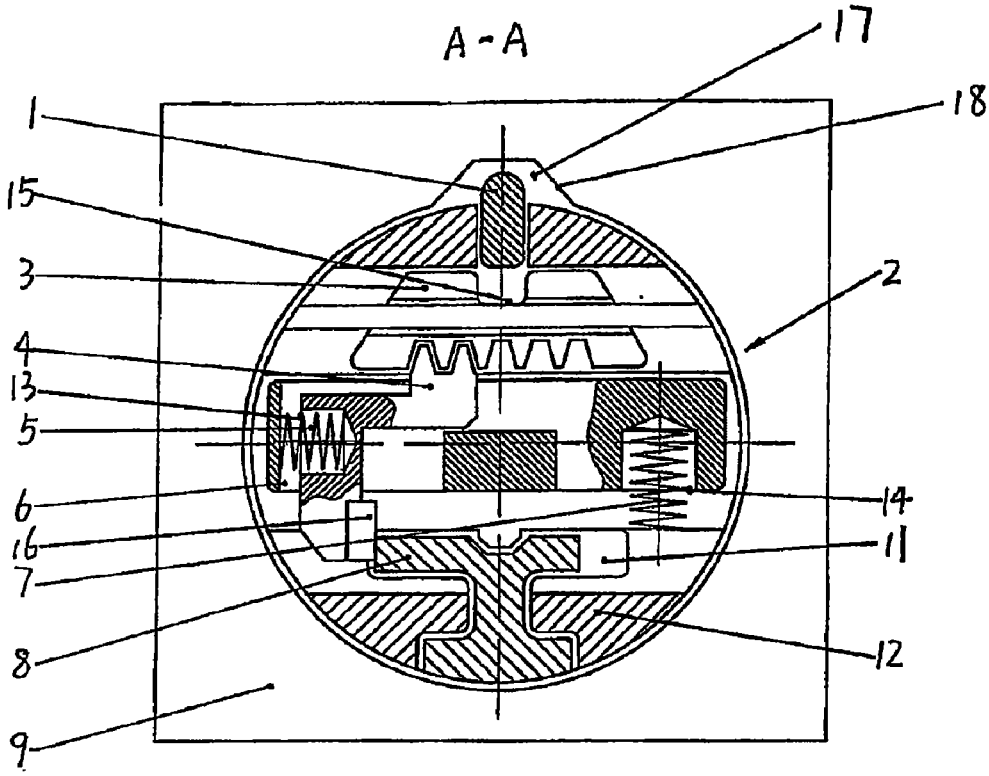
FIG. 2 is a cross-sectional view of FIG. 1 taken along A-A direction, where the locking block is at a first working position.
Figure 3:
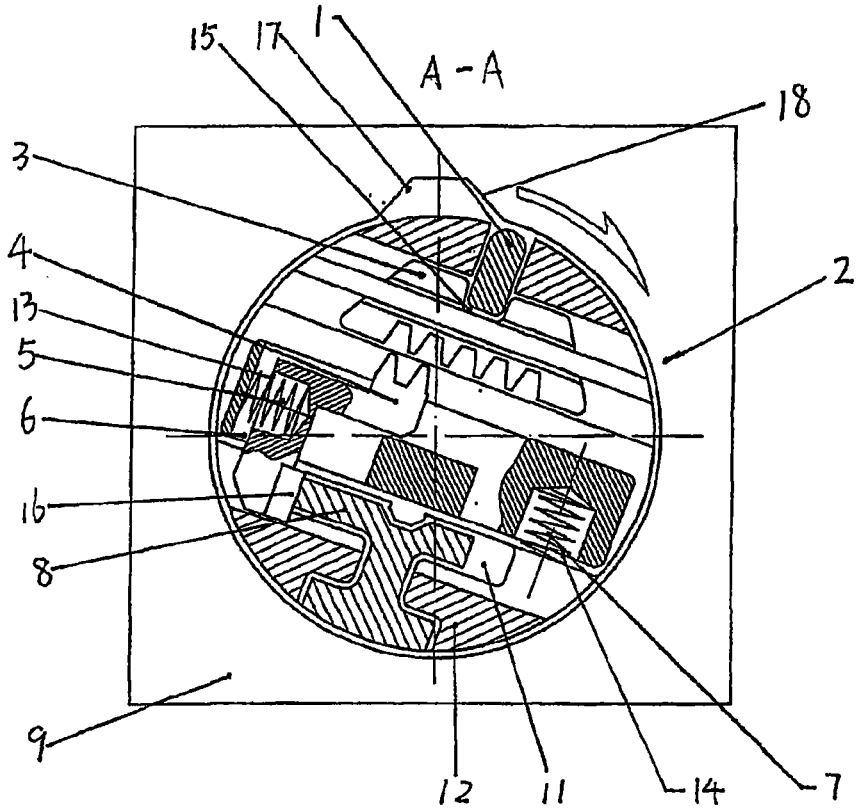
FIG. 3 is a cross-sectional view of FIG. 1 taken along A-A direction, where the locking block is at a second working position.

FIGS. 1 to 3 illustrate a key-changeable lock which includes a lock housing 9 and a lock cylinder 2 provided within the lock housing 9. The lock cylinder 2 includes a shell 12 for the lock cylinder, a locking hole 11 provided on the shell 12 and into which a key 8 can be inserted, and a locking block 1 slidably mounted on the shell 12. A sliding block 6 is slidably provided in the shell 12. The locking block 1 is abutted against the sliding block 6. Several springs 7 are provided between the sliding block 6 and the shell 12. Several toothed slides 4 are slidably provided within the sliding block 6. A compression spring 5 is disposed between each toothed slide 4 and the sliding block 6. A contactor 16, which is located within the locking hole 11, is fixed to the toothed slide 4. A toothed piece 3 is slidably disposed within the shell 12. The toothed piece 3 is provided with a block groove 15. The sliding direction of the sliding block 6 is perpendicular to that of the toothed slide 4. The locking block 1 can be situated at and operatively moved between two different working positions. At a first working position, the locking block 1 is not held in the block groove 15 and the teeth of the toothed piece 3 engage with those of the toothed slide 4. At a second working position, the locking block 1 is held in the block groove 15 and the teeth of the toothed piece 3 disengage from those of the toothed slide 4. A locking groove 17 is provided in the lock housing 9. When the locking block 1 is located at the first working position, the locking block 1 is received in the locking groove. The locking groove 17 is provided with guiding slants 18.

As shown in FIG. 2, when the key 8 is inserted in the locking hole 11 without being rotated, the teeth on the key 8 push the contactors 16 of the toothed slides 4 so as to slide the toothed slide 4 towards the left. Thus the toothed piece 3 slides towards the left due to the engagement of the teeth of the toothed slide 4 with those of the toothed piece 3.

This can enable the block groove 15 on the toothed piece 3 to be aligned with the licking block 1, while the locking block 1 is still at its first working position.

As shown in FIG. 3, when the key 8 is rotated, the lock cylinder 2 is rotated synchronously with the rotation of the key 8. Then, the locking block 1 comes out from the locking groove 17 along the guiding slant 18. Under the pressing of the lock housing 9, the locking block 1 slides into the block groove 15. Therefore, the locking block 1 reaches at its second working position. In this case, the lock cylinder 2 can be freely rotated with the key 8 in the lock housing 9, and thus the lock can be unlocked. Also as shown in FIG. 1, since the locking block 1 pushes against pins 10 fixed within the sliding block 6, the downward sliding of the locking block 1 will result in the downward sliding of the sliding block 6, and thus the spring 7 is compressed. As shown in FIG. 3, this can result that the toothed slide 4 provided within the sliding block 6 sliding down so that the teeth of the toothed slide 4 disengage from those of the toothed piece 3. In this case, if the key does not need to be changed, then after the lock is unlocked, by rotating the lock cylinder 2 with the key 8 so as to align the locking block 1 to the locking groove 17 on the lock housing 9, the sliding block 6 is pushed up by the compressed spring 7. As the locking block 1 is pushed by the pins 10, the locking block 1 is brought into the locking groove 17 on the lock housing 9. Thus, the teeth of the toothed slide 4 engage with those of the toothed piece 3 again. Because the teeth form of the key 8 does not change with respect to the teeth form of the contactor 16 of the toothed slide 4, the engagement position of the teeth of the toothed slide 4 with those of the toothed piece 3 is not changed. After the key 8 has been taken out, the lock is lock again. In the case shown in FIG. 3, in order to change the key with a new one, the key can be removed from the locking hole 11 and a new key substituted can be inserted into the locking hole 11. The new key is rotated reversely so as to align the locking block 1 to the locking groove 17 on the lock housing 9 and then is removed from the locking hole 11. Because the teeth form of the new key has been changed with respect to the teeth form of the contactor 16 of the toothed slide 4, a new engagement position of the teeth of the toothed slide 4 with those of the toothed piece 3 is established. For the new engagement position, the new key is valid and the old key is invalid. It means that the old key is changed by a new one. Next time, it is necessary to use the new key to unlock the lock again. Otherwise, the locking block 1 cannot be aligned to the block groove 15 of the toothed piece 3, and the lock cannot be unlocked.

The invention claimed is:

1. A key-changeable lock, comprising, in combination:

(a) a lock housing, (b) a lock cylinder for rotation within the lock housing about a rotational axis, the lock cylinder including, (i) a locking block slidably mounted on a periphery of locking cylinder, and having a first working position and a second working position, wherein the locking block extends from the lock cylinder to engage the lock housing, thereby directly preventing rotation of the lock cylinder relative the lock housing in the first working position, and wherein the locking block at least partially retracts into the lock cylinder to allow rotation in the second working position, (ii) a toothed piece with a block groove, wherein the toothed piece is movable to allow or block retraction of the locking block into the lock cylinder and the toothed piece is positioned entirely within the lock cylinder in both the first and second working positions, (iii) a toothed slide that moves in the lock cylinder transverse to the rotational axis, the toothed slide having engaged and disengaged positions with the toothed piece, the toothed piece moves in a fixed relationship with the toothed slide when in the engaged position, and in an independent relationship when in the disengaged position, (iv) a sliding block that moves the toothed slide between the engaged and disengaged positions, wherein the sliding block is moved by the locking block via pins extending between the locking block and sliding block, and (v) a locking hole provided on or in the lock cylinder and into which a key is inserted, wherein insertion of a first key into the locking hole moves the toothed slide and in turn the toothed piece into the engaged position, so that the block groove allows retraction of the locking block into the lock cylinder, wherein rotation of the first key in turn rotates the lock cylinder, the locking block retracts into the lock cylinder sliding into the blocking groove, wherein retraction of the locking block into the lock cylinder, i) prevents the toothed piece from moving with respect to the locking block, and (ii) slides the sliding block linearly in a direction perpendicular to the rotational axis to disengage the toothed slide from the toothed piece, and wherein removal of the first key and insertion of a second key moves the toothed slide to establish a new engaged position between the toothed slide and the toothed piece, so that the second key now locks and unlocks the key changeable lock.

2. The key-changeable lock as claimed in claim 1, wherein the first key is removed and the second key is inserted when the lock cylinder is in a partially rotated position.

3. The key-changeable lock of claim 1, wherein both the toothed slide and the toothed piece have teeth, and one of the toothed slide and the toothed piece has more teeth than the other of the the toothed slide and the toothed piece, to allow for a plurality of engaged positions between the toothed slide and the toothed piece, including the engaged position and the new engaged position.

4. The key-changeable lock of claim 1, wherein the block groove on the toothed piece runs parallel to the locking block, the toothed piece blocks retraction of the locking block, other than when the toothed piece is moved to allow the locking block to retract into the blocking groove.

5. The key-changeable lock of claim 1, wherein the locking block slides into the block groove, and is held in the block groove by the profile of the lock housing around the lock cylinder, when the lock is unlocked.

6. The key-changeable lock of claim 1, wherein springs between the sliding block and a shell bias the sliding block and the toothed slide into the engaged position.

7. The key-changeable lock of claim 1, wherein a compression spring is provided to bias the sliding block and in turn the toothed piece, when in the engaged position, to block retraction of the locking block.

8. The key-changeable lock of claim 7, wherein the compression spring is between the toothed slide and the sliding block.

9. The key-changeable lock of claim 1, wherein the sliding block and the toothed slide move parallel to one another.

10. The key-changeable lock of claim 1, wherein the sliding block moves perpendicular to the toothed piece.

11. The key-changeable lock of claim 1, wherein the first key is invalid after the new engaged position has been established with the second key.

12. The key-changeable lock of claim 1, wherein the locking block moves parallel to the sliding block.

13. The key-changeable lock of claim 1, wherein a contactor is fixed on the toothed slide and located within the locking hole to engage the second key.

14. The key-changeable lock of claim 1, wherein a locking groove is on the lock housing;

when the locking block is located at the first working position, the locking block is received in the locking groove; and each side face of the locking groove has a guiding slant.

15. A key-changeable lock, comprising, in combination:

a lock housing; and a lock cylinder rotatable about a rotational axis within the lock housing, the lock cylinder includes a shell for the lock cylinder, a locking hole on the shell into which a key is inserted, and a locking block is slidably mounted on the shell between a first working position and a second working position;

a sliding block slidable in the shell linearly in a direction perpendicular to the rotational axis free of the lock housing, wherein the locking block abuts against a pin fixed within the sliding block and moves the sliding block via the pin, and a toothed slide slidable in the sliding block, and a toothed piece having a block groove, wherein the toothed piece is slidably disposed in the shell and positioned entirely within the cylinder in both the first and second working positions, and wherein the locking block is not held in the block groove, the locking block extends from the lock cylinder to engage the lock housing thereby directly preventing rotation of the lock cylinder relative to the lock housing and the toothed piece engages the toothed slide when the locking block is in the first working position, and wherein the locking block is held in the block groove and at least partially retracts into the lock cylinder to allow relative rotation of the lock cylinder with respect to the lock housing, and the toothed piece disengages the toothed slide when the locking block is in the second working position.

16. The key-changeable lock of claim 15, wherein springs are positioned between the sliding block and the shell.

17. The key-changeable lock of claim 15, wherein a compression spring is between the toothed slide and the sliding block.

18. The key-changeable lock of claim 15, wherein the sliding block moves perpendicular to the toothed piece.

19. The key-changeable lock of claim 15, wherein a contactor is fixed on the toothed slide and located in the locking hole.

20. The key-changeable lock of claim 15, wherein a locking groove is on the lock housing;

when the locking block is in the first working position, the locking block is received in the locking groove; and each side face of the locking groove has a guiding slant.

* * * * *